United States Patent [19]

Hutson

[11] Patent Number: 4,589,272

[45] Date of Patent: May 20, 1986

[54] APPARATUS FOR CONNECTING A HYDRAULICALLY ACTUATED TOOL TO A CONTROL VALVE

[76] Inventor: Roy C. Hutson, 1418 Sandy Hollow Rd., Rockford, Ill. 61109

[21] Appl. No.: 715,882

[22] Filed: Mar. 25, 1985

[51] Int. Cl.[4] ..... B21J 9/18

[52] U.S. Cl. ..... 72/453.16; 72/453.18; 72/410; 72/445; 81/301; 92/59; 92/128; 91/467

[58] Field of Search ..... 72/453.18, 453.04, 453.15, 72/453.16, 410, 412, 416, 445; 81/301; 91/467; 92/59, 128, 108, 110

[56] References Cited

U.S. PATENT DOCUMENTS

| | | | |
|---|---|---|---|
| 2,941,430 | 6/1960 | Klingler | 81/301 |
| 3,021,869 | 2/1962 | Ross | 137/621 |
| 3,326,029 | 6/1967 | Porter | 72/453.16 |
| 3,786,669 | 1/1974 | Lines | 72/453.15 |
| 4,292,833 | 10/1981 | Lapp | 72/416 |
| 4,342,332 | 8/1982 | Lapp | 137/625 |
| 4,366,673 | 1/1983 | Lapp | 60/477 |

*Primary Examiner*—Francis S. Husar
*Assistant Examiner*—David B. Jones
*Attorney, Agent, or Firm*—Leydig, Voit & Mayer, Ltd.

[57] ABSTRACT

To enable a tool with a hydraulic actuator to be connected directly and quickly to a four-way, three-position control valve, the bodies of the tool and the valve are formed with sockets which receive fittings for establishing fluid communication between the tool and the valve. The fittings are anchored in the sockets of one of the bodies and are adapted to be telescoped slidably into the sockets in the other body to enable the bodies to be quickly and easily connected to and disconnected from one another. The arrangement is such that the same four-way, three-position control valve may be connected either to a tool having a double-acting hydraulic actuator or to a tool having a single-acting hydraulic actuator.

8 Claims, 4 Drawing Figures

APPARATUS FOR CONNECTING A HYDRAULICALLY ACTUATED TOOL TO A CONTROL VALVE

BACKGROUND OF THE INVENTION

This invention relates generally to a hydraulically operated tool and to a valve for controlling operation of the tool.

The tool with which the invention is concerned comprises a tool member which is shifted through active and return strokes by a reciprocating hydraulic actuator. The actuator may be of the double-acting type which shifts the tool member in one direction when pressurized oil is supplied to one side of the actuator and returns the tool member in the opposite direction when pressurized oil is supplied to the other side of the actuator. In other tools, the actuator may be of the single-acting type in which the tool member is shifted in one direction when pressurized oil is supplied to one side of the actuator and then is returned by a spring when the hydraulic pressure on the one side of the actuator is relieved by exhausting the oil from the actuator.

The control valve with which the invention is concerned is a four-way valve and may be of the same general type as disclosed in Hutson U.S. application Ser. No. 628,152, filed July 5, 1984 and entitled Three-Position, Four-Way, Short-Stroke Rotary Valve. In general, such a valve includes a valve member which may be shifted in opposite directions from a neutral position to first or second active positions. In the first active position of the valve member, pressurized oil is supplied through a first passageway of the valve and low pressure oil may be exhausted to drain through a second passageway. When the valve member is shifted to its second active position, pressurized oil may be supplied to the second passageway while low pressure oil may be exhausted to drain through the first passageway. Four-way valves conventionally are used to control tools having double-acting hydraulic actuators.

With most commercially available hydraulically actuated tools, the control valve is either connected to the hydraulic actuator by flexible hoses or forms a permanent part of the tool itself. In some cases, the presence of the hoses makes it difficult to manipulate and maneuver the tool. If the control valve is part of the tool itself, a separate control valve is required for each separate tool.

SUMMARY OF THE INVENTION

The general aim of the present invention is to provide new and improved coupling apparatus by which a hydraulic control valve may be connected directly to a hydraulically actuated tool and without the need of hoses so as to facilitate ease of use of the tool. In addition, the control valve may be quickly connected to and disconnected from the tool so that the same valve may be used with different tools.

Another object of the invention is to provide unique coupling apparatus which not only enables a four-way control valve to be quickly and directly connected to a tool with a double-acting actuator but which also enables the same four-way valve to be used effectively when connected directly to a tool having a single-acting actuator.

A more detailed object is to provide novel fittings adapted to fit in sockets in the bodies of the tool and the valve to establish fluid communication between the valve and the tool while enabling the two to be quickly and easily connected and disconnected.

These and other objects and advantages of the invention will become more apparent from the following detailed description when taken in conjunction with the accompanying drawings.

DETAILED DESCRIPTION OF THE PREFERRED EMBODIMENTS

Figure 1:
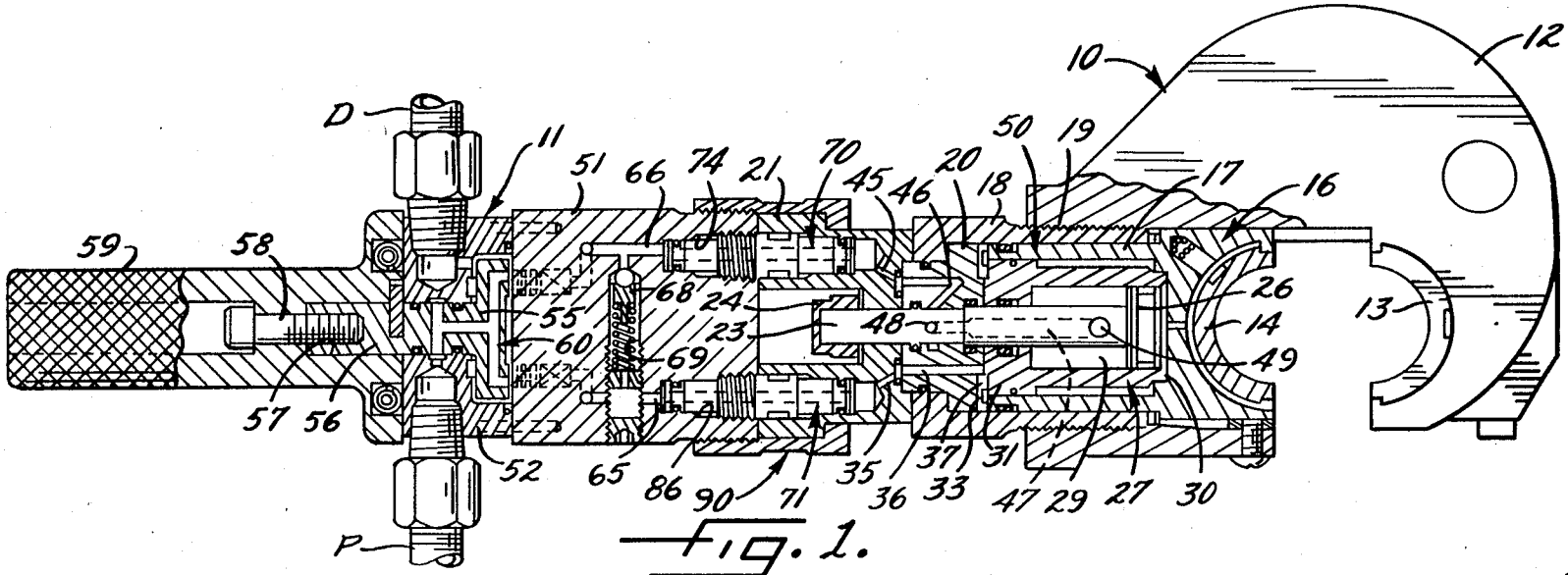
FIG. 1 is a fragmentary cross-sectional view showing a tool with a double-acting actuator conncted to a four-way control valve by new and improved coupling apparatus incorporating the unique features of the present invention.

For purposes of illustration, the invention is shown in the drawings in conjunction with a hydraulically actuated tool 10 and a valve 11 for controlling actuation of the tool. While the tool may take a variety of forms, the tool which has been specifically illustrated is a crimping tool having a head 12 which supports a fixed crimping die 13. When a tool member in the form of a movable crimping die 14 is advanced toward the fixed die, the dies coact to crimp a workpiece (not shown) located between the dies.

The movable die 14 is attached rigidly to a die holder 16 which is supported by the head 12 to move toward and away from the fixed die 13. A cylindrical sleeve 17 is formed integrally with and extends rearwardly from the die holder and is slidably received within a second sleeve 18. The sleeve 18 is threaded into the head 12 as indicated at 19 and receives a block-like distributor member 20.

The tool 10 further includes a generally cylindrical and block-like body 21 which is attached rigidly to the distributor 20. Extending through the body 21 and the distributor 20 is an elongated rod 23 which is fixed within the body by a nut 24 on one end of the rod. A piston 26 is attached rigidly to the other end of the rod and supports a slidable cylinder member 27 defining a chamber 29. The cylinder 27 is received slidably within the sleeve 17 and is positioned with its forward end 30 in direct engagement with the die holder 16. The rear end portion 31 of the cylinder 27 is slidable within the sleeve 17 and is prevented from sliding rearwardly out of the sleeve 17 by a retainer ring 33.

A first passage 35 is formed in the body 21 and communicates with a passage 36 in the distributor 20. The forward end of the passage 36 communicates with a chamber 37 defined between the adjacent ends of the distributor 20 and the cylinder 27.

A second passage 45 (FIGS. 1 and 3) in the body 21 communicates with another passage 46 (FIG. 1) in the distributor 20. The passage 46 communicates with a longitudinally extending passage 47 in the rod 23 via a hole 48 in the inner end portion of the rod. A hole 49 in the outer end portion of the rod also communicates with the passage 47 and establishes communication between the passage 47 and the chamber 29 inside of the cylinder 27.

To advance the movable die 14 toward the fixed die 13, high pressure oil is supplied to the first passage 35 and flows through the passage 36 to the chamber 37. Such high pressure oil acts against the rear end 31 of the cylinder 27 and forces the cylinder to slide forwardly along the piston 26 so that the forward end 30 of the cylinder pushes the die holder 16 and the die 14 forwardly. As the cylinder 27 slides forwardly, low pressure oil within the chamber 29 of the cylinder is exhausted to drain via the hole 49, the passage 47, the hole 48 and the passages 46 and 45.

Retraction of the movable die 14 is effected by supplying high pressure oil to the second passage 45. Such oil flows through the passage 46, the hole 48, the passage 47 and the hole 49 and then flows into the chamber 29 in the cylinder 27. The pressure within the chamber 29 acts between the cylinder 27 and the fixed piston 26 and forces the cylinder rearwardly away from the piston with the rear end 31 of the cylinder acting against the retainer ring 33 to shift the sleeve 17 and the die holder 16 rearwardly. As the cylinder 27 moves rearwardly, low pressure oil in the chamber 37 is exhausted to drain by way of the passages 36 and 35.

Thus, the arrangement which has been described forms a double-acting hydraulic actuator 50 which advances the movable die 14 when high pressure oil is supplied to a first side (i.e., the chamber 37) of the actuator via the first passage 35 and when low pressure oil is exhausted from the other or second side (i.e., the chamber 29) of the actuator, the low pressure oil ultimately being exhausted through the second passage 45. The actuator 50 retracts the movable die when high pressure oil is supplied to the second side or chamber 29 of the actuator via the passage 45 and when low pressure oil is exhausted from the first side or chamber 37 of the actuator by way of the passage 35.

The control valve 11 may be identical to the valve disclosed in the aforementioned Hutson application. Briefly, such a valve includes a housing formed by a body 51 and a cap 52 which are secured rigidly together. High pressure oil at about 10,000 p.s.i. is delivered to the valve by a pressure line P leading from a pump (not shown) and connected to one side of the valve cap 52. A drain line D is connected to the other side of the cap and leads to a drain or return tank (not shown).

A chamber is defined between the valve body 51 and the valve cap 52. A cylindrical valve member 55 in the form of a disc is rotatably supported within the chamber. A shaft 56 is formed integrally with and extends rearwardly from the valve disc 55 and is rotatably received within a bore 57 in the cap. Connected to the rear end of the shaft by a screw 58 is an elongated handle 59 which may be turned about its own axis to turn the valve disc between different positions. A passage system indicated generally by the reference numeral 60 is formed in the valve body 51, the valve cap 52, the valve disc 55 and the shaft 56 to cause oil to flow in different paths depending upon the angular position of the valve disc.

Normally, the valve disc 55 is located in a neutral position. In this instance, the valve 11 is of the open center type so that, when the valve disc 55 is in its neutral position, communication is established directly between the pressure line P and the drain line D.

When the valve disc 55 is rotated in one direction from its neutral position to a first active position, the passage system 60 causes high pressure oil from the pressure line P to flow to a first passageway 65 formed in the valve body 51. At the same time, a second passageway 66 in the valve body is placed in communication with the drain line D so that low pressure oil in the passageway 66 may exhaust to the return tank.

Conversely, rotation of the valve disc 55 in the opposite direction from its neutral position to a second active position establishes communication between the pressure line P and the passageway 66 so that high pressure oil is supplied to that passageway. When the valve disc 55 is in its second active position, the passageway 65 communicates with the drain line D and thus low pressure oil in the passageway 65 may exhaust to the return tank.

In the event that the pressure in the passageway 66 exceeds a predetermined magnitude (e.g., 5,000 p.s.i.), a relief valve 68 pops and unloads to allow pressurized oil in the passageway 66 to flow to the return tank via the passageway 65. The relief valve 68 is located in a third passageway 69 formed in the valve body 51 and extending between the passageways 65 and 66.

In accordance with the present invention, the tool 10 is coupled to the valve 11 in a unique manner which enables a direct connection of the tool and valve and which also permits quick and easy separation of the two. As a result, the valve may be carried directly by the tool to facilitate maneuvering and manipulation of the tool but, at the same time, may be quickly disconnected from the tool and used with other tools.

In carrying out the foregoing, the invention contemplates the provision of new and improved coupling apparatus having unique fittings 70 and 71 which establish fluid communication between the tool 10 and the valve 11 while enabling the valve to be quickly connected to and disconnected from the tool. The two fittings are identical and thus a description of one will suffice for both.

Figure 3:
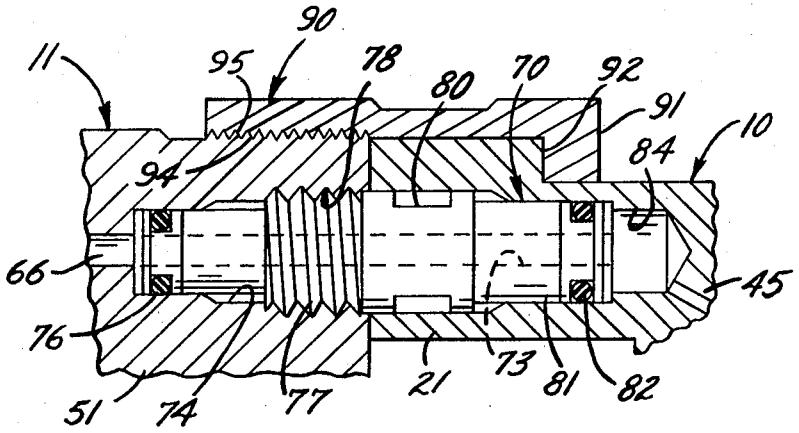
FIG. 3 is an enlarged fragmentary cross-sectional view of certain parts of the coupling apparatus shown in FIG. 1.

As shown most clearly in FIG. 3, the fitting 70 is an elongated tubular member which is formed with a longitudinal flow passage 73 that extends from one end of the fitting to the other. The rear end portion of the fitting 70 is received within a socket 74 formed in and opening out of the forward end of the valve body 51 and communicating with the passageway 66, the latter passageway thus communicating directly with the internal passage 73 of the fitting. An O-ring 76 encircles the extreme rear end portion of the fitting 70 and seals against the wall of the socket 74. An intermediate portion 77 of the fitting is externally threaded and is adapted to be screwed tighty into an internally threaded section 78 of the socket 74, the threaded section 78 being located in the extreme forward end portion of the valve body 51.

Formed as an integral part of the fitting 70 and projecting outwardly of the valve body 51 is a wrenching flat 80 which may be engaged by a wrench in order to turn the fitting and anchor the fitting tightly in the socket 74. A probe portion 81 extends outwardly from the wrenching flat 80 and is fitted with an O-ring 82. The probe portion 81 is adapted to telescope slidably into a socket 84 (FIGS. 2 and 3) formed in the extreme rear end portion of the tool body 21 and communicating with the passage 45 therein, the passage 45 thus communicating with the internal passage 73 in the fitting 70 by way of the socket 84. The O-ring 82 seals the probe portion 81 of the fitting 70 to the wall of the socket 84.

The fitting 71 is threaded into a valve body socket 86 (FIG. 2) identical to the socket 74 and communicating with the passageway 65 in the valve body 51. In addition, the probe portion 81 of the fitting 71 is adapted to telescope slidably within a socket 87 (FIG. 2) which is identical to the socket 84, the socket 87 being formed in the rear end of the tool body 21 and communicating with the passage 35. Thus, the internal passage 73 in the fitting 71 establishes communication between the passageway 65 and the passage 35.

The coupling apparatus is completed by a coupling nut 90 (FIG. 3) which is rotatably supported by the tool body 21. A radially inwardly projecting flange 91 on the forward end of the coupling nut is adapted to engage a radially outwardly projecting shoulder 92 on the rear end portion of the tool body 21. In addition, the rear end portion of the nut is internally threaded as indicated at 94 and is adapted to be screwed onto an externally threaded portion 95 of the valve body 51 adjacent the forward end thereof.

Figure 2:
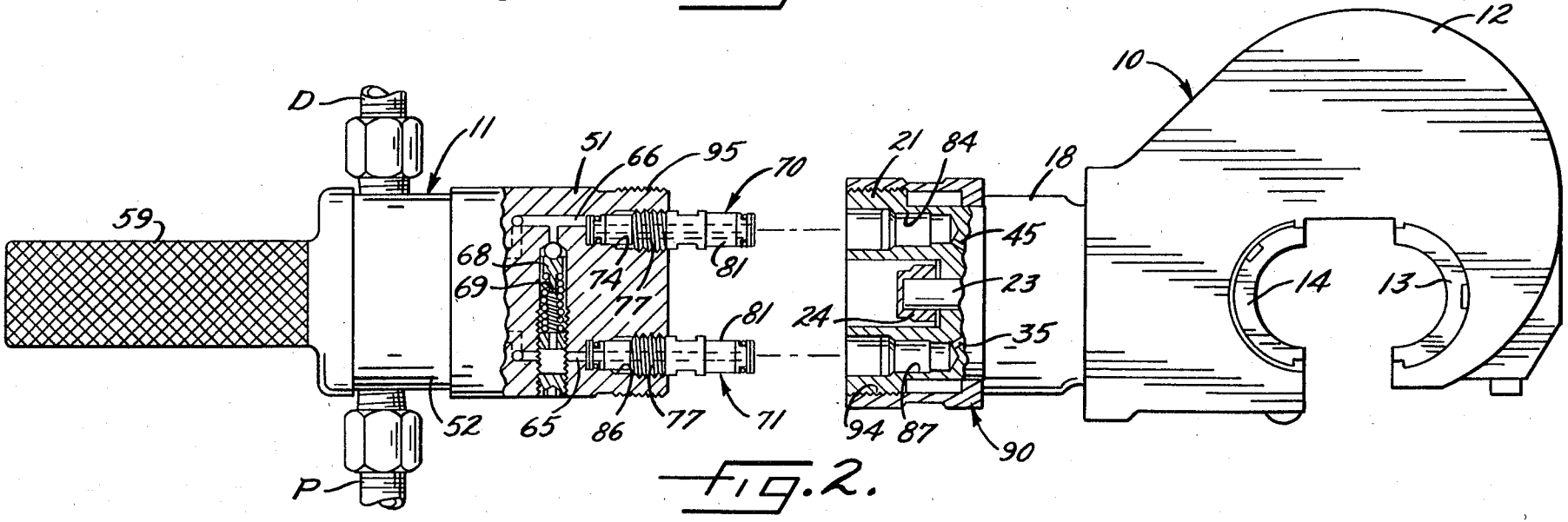
FIG. 2 is a fragmentary cross-sectional view similar to FIG. 1 but shows the tool disconnected from the valve.

With the foregoing arrangement, the fittings 70 and 71 are attached permanently to the valve body 51 and are located with the probe portions 81 of the fittings projecting fowardly from the valve body as shown in FIG. 2. When the tool 10 and the valve 11 are positioned as shown in FIG. 2, the valve may be moved forwardly toward the tool to cause the probe portions 81 of the fittings 70 and 71 to telescope slidably into the sockets 84 and 87, respectively, of the tool body 21. Thereafter, the coupling nut 90 may be tightened to cause the nut to thread onto the valve body 51 and to cause the flange 91 to clamp against the shoulder 92. Final tightening of the coupling nut clamps the two bodies 21 and 51 tightly together and causes the probe portions 81 of the fittings 70 and 71 to seat snugly in the bores 84 and 87, respectively.

With the tool 10 and the valve 11 thus assembled, the first passageway 65 of the valve communicates with the first passage 35 of the tool via the passage 73 in the fitting 71 while the second passageway 66 of the valve communicates with the second passage of the tool by way of the passage 73 in the fitting 70. Accordingly, turning of the valve disc 55 from its neutral position to its first active position serves to supply pressurized oil to the chamber 37 and to exhaust oil from the chamber 29 so as to cause the actuator 50 to advance the movable die 14. When the valve disc 55 is turned in the opposite direction to its second active position, pressurized oil is supplied to the chamber 29 and oil is exhausted from the chamber 37 and thus the actuator retracts the movable die. The relief valve 68 prevents extremely high pressure from building up in the supply side of the system during retraction of the movable die and thus helps maintain the integrity of seals and the like.

By loosening the coupling nut 90, the tool body 21 may be released from the valve body 51. Thereafter, the valve body may be separated axially from the tool body to pull the fittings 70 and 71 out of the sockets 84 and 87. The valve then may be attached directly to a different tool having a body 21 similar to that of the tool 10.

Figure 4:
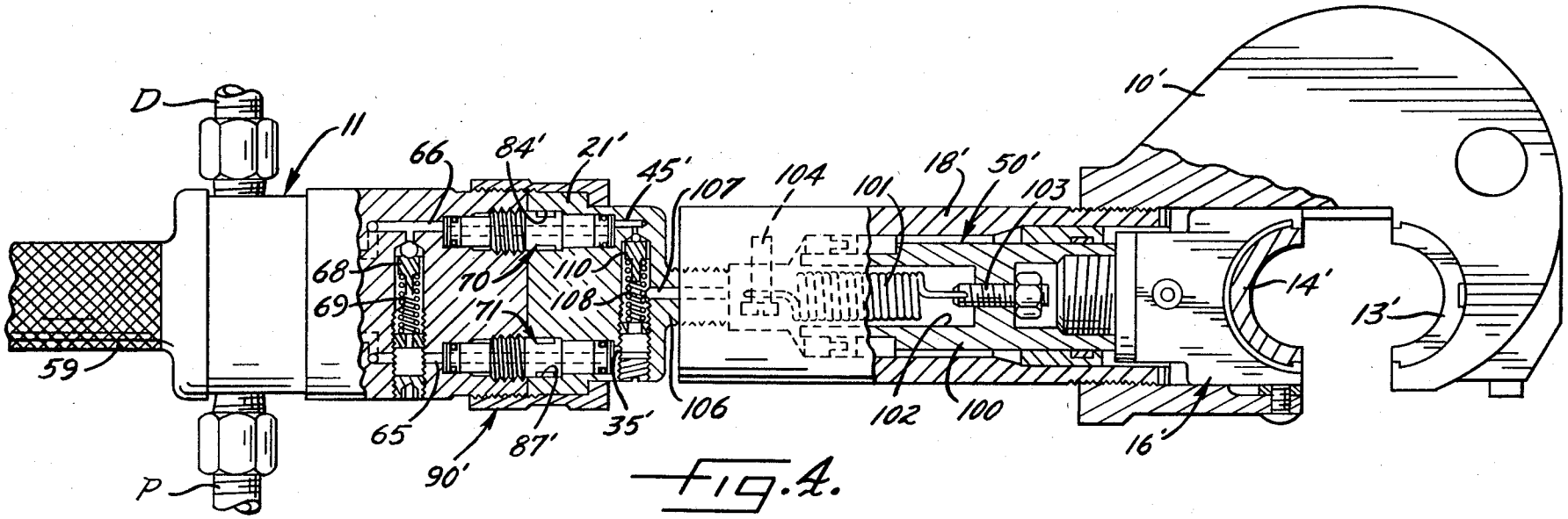
FIG. 4 is a fragmentary cross-sectional view showing a tool with a single-acting actuator connected to the four-way control valve by the coupling apparatus of the invention.

Advantageously, the same four-way valve 11 may be used to control a tool 10' (FIG. 4) having a single-acting hydraulic actuator 50'. Such a tool has been shown in FIG. 4 in which parts corresponding generally to parts of the tool 10 have been indicated by the same but primed reference numerals.

Briefly, the tool 10' includes a sleeve 18' which slidably supports a piston member 100, the latter being attached rigidly to the die holder 16'. A tension spring 101 is disposed within a chamber 102 in the piston and is anchored at one end to a screw 103 on the piston and at its other end to a screw 104 on the sleeve 18'.

When high pressure oil is supplied to one side (i.e., the chamber 102) of the actuator 50', the piston 100 is advanced and moves the movable die 14' toward the fixed die 13'. When oil is exhausted from the chamber 102, the spring 101 retracts the movable die.

The tool 10' includes a body 21' which is anchored rigidly to the end of the sleeve 18' by virtue of the body 21' having a neck 106 which is threaded into the sleeve 18'. Formed through the neck 106 is a passage 107 which communicates with the chamber 102 and which also communicates with a cross passage 108 formed in the body 21'. The cross passage 108 extends between passages 35' and 45' which, for all practical purposes, are identical to the passages 35 and 45, respectively, of the body 21' of the tool 10' of the first embodiment. A spring-loaded relief valve 110 is disposed in the cross passage 108 with sufficient clearance to open and allow a steady flow of oil directly from the passage 45' to the passage 35' when the pressure in the passage 45' reaches a predetermined magnitude (e.g., 2,500 p.s.i.). The relief valve 110 blocks the flow of oil from the passage 35' to the passage 45' by way of the cross passage 108.

Except for the diferences noted above, the body 21' of the tool 10' is identical to the body 21 of the tool 10 and includes sockets 84' and 87' which receive the fittings 70 and 71 that are attached to the valve 11. A coupling nut 90' identical to the coupling nut 90 is attached to the body 21' of the tool 10'.

Thus, the tool 10' with the single-acting actuator 50' may be quickly connected to and disconnected from the valve 11 in the same manner as the tool 10 with the double-acting actuator 50. When the tool 10' is attached to the valve 11, turning of the valve disc 55 from its neutral position to its first active position causes high pressure oil to flow through the passage 65, the passage 73 in the fitting 71, and the passage 35' into the cross passage 108. The high pressure oil then flows through the passage 107 and into the chamber 102 to advance the movable die 14'.

Turning of the valve disc 55 from its neutral position to its second active position allows the oil in the chamber 102 to exhaust therefrom and to flow reversely along the path described immediately above. Pressurized oil is supplied to the passage 45' when the valve disc is in its second active position but, under such circumstances, the relief valve 110 cracks open and remains at about 2,500 p.s.i. and allows a steady flow of oil through the cross passage 108. Such flow through the cross passage 108 is of low volume and low pressure when compared to the charge oil being exhausted from the chamber 102. Thus, the flow through the cross passage 108 returns to drain directly through the passage 35' and does interfere with the action of the spring 101 in retracting the movable die 14'. The steady flow permitted through the passage 108 by the relief valve 110 avoids repetitive popping or unloading of the main relief valve 68.

From the foregoing, it will be apparent that the present invention brings to the art new and improved coupling apparatus which allows a four-way valve to be connected quickly and directly to a tool. The nature of the coupling apparatus is such that the same four-way valve 11 may be used either with a tool 10 having a double-acting actuator 50 or a tool 10' having a single-acting actuator 50'.

I claim:

1. The combination of, a hydraulically operated tool, a hydraulic control valve, and means for quickly connecting said tool directly to said control valve;

said tool comprising a tool member, a reciprocating actuator connected to said tool member, said actuator being operable to cause said tool member to shift in one direction when pressurized oil is supplied to one side of the actuator and being operable to cause said tool member to shift in the opposite direction when oil is exhausted from said one side of said actuator, and a body connected to said actuator and having first and second passages with one of said passages communicating with said one side of said actuator, said body also having first and second sockets in one end thereof and communicating with said first and second passages, respectively;

said hydraulic control valve comprising a body having first and second passageways, said valve body also having first and second sockets in one end thereof and communicating with said first and second passageways, respectively, a valve member movable relative to said valve body between first and second positions, said valve member being operable when in said first position to cause pressurized oil to be supplied through one of said passageways and being operable when in said second position to cause oil to be exhausted through one of said passageways, and said connecting means comprising first and second fittings each having a passage means formed therethrough, each fitting being anchored in a socket in one of said bodies, projecting from such body and being sized to telescope slidably within a socket in the other of said bodies, the passage means in said first fitting establishing communication between said first passage of said tool and said first passageway of said valve, the passage means in said second fitting establishing communication between said second passage of said tool and said second passageway of said valve, and said connecting means further comprising a threaded coupler rotatably supported by one of said bodies and adapted to be threadably connected to the other body, said coupler being operable when tightened to clamp said bodies together and keep said fittings telescoped in said sockets, said coupler being operable when loosened to permit complete separation of said bodies and to permit said fittings to slide out of telescoping relation with said sockets thereby to enable said tool to be detached from said control valve.

2. The combination defined in claim 1 in which said actuator is a double-acting actuator which is operable to shift said tool member in one direction when pressurized oil is supplied to a first side of the actuator and when oil is exhausted from a second side of the actuator, said actuator being operable to shift said tool member in the opposite direction when pressurized oil is supplied to the second side of the actuator and when oil is exhausted from the first side of the actuator, said first and second passages communicating with the first and second sides, respectively, of said actuator, said valve member being operable when in said first position to cause pressurized oil to be supplied through said first passageway and to cause oil to be exhausted through said second passageway, and said valve member being operable when in said second position to cause pressurized oil to be supplied through said second passageway and to be exhausted through said first passageway.

3. The combination defined in claim 1 in which said actuator is a single-acting actuator, a spring connected to said tool member for shifting said tool member in said opposite direction when oil is exhausted from said one side of said actuator, said first passage of said tool body communicating with said one side of said actuator, said valve member being operable when in said first position to cause pressurized oil to be supplied through said first passageway and to connect said second passageway to a low pressure drain, said valve member being operable when in said second position to cause pressurized oil to be supplied to said second passageway and to connect said first passageway to said drain, a third passage in said tool body and establishing communication between said first and second passages of said tool body, and means in said third passage preventing pressurized oil from flowing from said first passage to said second passage by way of said third passage when said valve member is in said first position while permitting pressurized oil to flow from said second passage to said first passage by way of said third passage when said valve member is in said second position and the pressure of such oil exceeds a predetermined magnitude.

4. The combination defined in claim 1 in which each of said fittings comprises an elongated tubular member having an externally threaded end portion, the socket in which each fitting is anchored being internally threaded and threadably receiving said threaded end portion.

5. The combination defined in claim 1 in which said fittings are threaded in the sockets in said valve body and are sized to telescope slidably into the sockets in said tool body.

6. The combination defined in claim 5 in which each of said fittings comprises an elongated tubular member, and O-rings encircling each end portion of each fitting and operable to seal said end portions within said sockets.

7. The combination of, a hydraulically operated tool, a hydraulic control valve, and means for quickly connecting said tool directly to said control valve;

said tool comprising a tool member, a double-acting, reciprocating hydraulic actuator connected to said tool member, said actuator being operable to shift said tool member in one direction when pressurized oil is supplied to a first side of the actuator and when oil is exhausted from a second side of the actuator and being operable to shift said tool member in the opposite direction when pressurized oil is supplied to the second side of the actuator and when oil is exhausted from the first side of the actuator, and a body connected to said actuator and having first and second passages communicating with the first and second sides, respectively, of said actuator, said body also having first and second sockets in one end thereof and communicating with said first and second passages, respectively;

said hydraulic control valve comprising a body having first and second passageways, said valve body also having first and second sockets in one end thereof and communicating with said first and second passageways, respectively, a valve member movable relative to the valve body between first and second positions, said valve member being operable when in said first position to cause pressurized oil to be supplied through said first passageway and to cause oil to be exhausted through said second passageway, said valve member being operable when in said second position to cause pressurized oil to be supplied through said second passageway and to cause oil to be exhausted through said first passageway;

and said connecting means comprising first and second fittings each having a passage means formed therethrough, each fitting being anchored in a socket in one of said bodies, projecting from such body and being sized to telescope slidably within a socket in the other of said bodies, the passage means in said first fitting establishing communication between said first passage of said tool and said first passageway of said valve, the passage means in said second fitting establishing communication between said second passage of said tool and said second passageway of said valve, and said connecting means further comprising a threaded coupler rotatably supported by one of said bodies and adapted to be threadably connected to the other body, said coupler being operable when tightened to clamp said bodies together and keep said fittings telescoped in said sockets, said coupler being operable when loosened to permit complete separation of said bodies and to permit said fittings to slide out of telescoping relation with said sockets thereby to enable said tool to be detached from said control valve.

8. The combination of, a hydraulically operated tool, a hydraulic control valve, and means for quickly connecting said tool directly to said control valve;

said tool comprising a tool member, a singleacting, reciprocating hydraulic actuator connected to said tool member, said actuator being operable to shift said tool member in one direction when pressurized oil is supplied to one side of said actuator and being operable to enable said tool member to shift in the opposite direction when oil is exhausted from said one side of said actuator, a spring connected to said tool member for shifting said tool member in said opposite direction when oil is exhausted from said one side of said actuator, and a body connected to said actuator and having first, second and third passages, said first passage communicating with said one side of said actuator, said third passage establishing communication between said first and second passages, means in said third passage preventing pressurized oil from flowing from said first passage to said second passage by way of said third passage while permitting pressurized oil to flow from said second passage to said first passage by way of said third passage when the pressure of such oil exceeds a predetermined magnitude, said body also having first and second sockets in one end thereof and communicating with said first and second passages, respectively;

said hydraulic control valve comprising a body having first and second passageways, said valve body also having first and second sockets in one end thereof and communicating with said first and second passageways, respectively, a valve member movable relative to said valve body between first and second positions, said valve member being operable when in said first position to cause pressurized oil to be supplied through said first passageway and to connect said second passageway to a low pressure drain, said valve member being operable when in said second position to cause pressurized oil to be supplied to said second passageway and to connect said first passageway to said drain;

and said connecting means comprising first and second fittings each having a passage means formed therethrough, each fitting being anchored in a socket in one of said bodies, projecting from such body and being sized to telescope slidably within a socket in the other of said bodies, the passage means in said first fitting establishing communication between said first passage of said tool and said first passageway of said valve, the passage means in said second fitting establishing communication between said second passage of said tool and said second passageway of said valve, and said connecting means further comprising a threaded coupler rotatably supported by one of said bodies and adapted to be threadably connected to the other body, said coupler being operable when tightened to clamp said bodies together and keep said fittings telescoped in said sockets, said coupler being operable when loosened to permit complete separation of said bodies and to permit said fittings to slide out of telescoping relation with said sockets thereby to enable said tool to be detached from said control valve.

* * * * *